US010538985B2

(12) United States Patent
Cookston

(10) Patent No.: US 10,538,985 B2
(45) Date of Patent: Jan. 21, 2020

(54) STACKABLE SUPPORT SYSTEM AND METHOD

(71) Applicant: ONESUBSEA IP UK LIMITED, London (GB)

(72) Inventor: Christopher John Cookston, Rosenberg, TX (US)

(73) Assignee: ONESUBSEA IP UK LIMITED, London, England (GB)

( * ) Notice: Subject to any disclaimer, the term of this patent is extended or adjusted under 35 U.S.C. 154(b) by 498 days.

(21) Appl. No.: 15/341,750

(22) Filed: Nov. 2, 2016

(65) Prior Publication Data

US 2017/0122059 A1 May 4, 2017

Related U.S. Application Data

(60) Provisional application No. 62/250,975, filed on Nov. 4, 2015.

(51) Int. Cl.
*E21B 33/04* (2006.01)

(52) U.S. Cl.
CPC ..... *E21B 33/04* (2013.01)

(58) Field of Classification Search
CPC ..... E21B 23/02; E21B 33/04
See application file for complete search history.

(56) References Cited

U.S. PATENT DOCUMENTS 7,380,607 B2 6/2008 Thomas
2012/0024540 A1* 2/2012 Harsono ..... E21B 33/035 166/382

FOREIGN PATENT DOCUMENTS

GB 2497409 A 6/2013
WO 0236932 A1 5/2002

OTHER PUBLICATIONS

PCT International Search Report & Written Opinion for PCT Application No. PCT/EP2016/076574 dated Jan. 25, 2017; 12 Pages.

* cited by examiner

*Primary Examiner* — Caroline N Butcher
(74) *Attorney, Agent, or Firm* — Fletcher Yoder, P.C.

(57) ABSTRACT

A stackable support system and method are disclosed to increase the final contact area of an expanding lock component by stacking one ring on top of another such that one ring acts as an actuator for the one beneath it. As a body lands inside a receptacle, e.g. a narrow cylinder lands inside a larger cylinder, the components or rings expand in a domino effect, resulting in a greater contact between the body and receptacle than would occur if there was only one component or ring. The stackable support system includes a number of expandable lock rings which stack on top of each other. These rings, when expanded, steadily increase in diameter, resulting in an overall larger surface on the bottom of the support system than could have been achieved with one ring.

21 Claims, 6 Drawing Sheets

STACKABLE SUPPORT SYSTEM AND METHOD

CROSS-REFERENCE TO RELATED APPLICATIONS

This application claims priority to and the benefit of U.S. Provisional Application No. 62/250,975, filed Nov. 4, 2015, and entitled "Stackable Support System and Method," the disclosure of which is incorporated by reference in its entirety for all purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In the oil and gas industry, a well may be drilled and a completion system may be installed at a surface end of the well in order to extract oil, natural gas, and/or other subterranean resources from the earth. Such a completion system may be located onshore or subsea depending on the location of the desired resource and/or well. A completion system generally includes a wellhead assembly through which a resource is extracted or fluids are injected. Subsea wellhead system equipment typically features cylindrical bodies which contact and rest in larger cylindrical bodies via expanding split rings, split lock rings, split load rings, or C-rings. For example, a casing hanger may use this technology to hang a casing string inside a receptacle welded to a larger casing string.

A typical subsea wellhead assembly includes a wellhead housing that supports one or more casing hangers. A casing hanger may land on and be supported by a load shoulder, which may be installed on a special running tool or may be run with the casing hanger. One type of wellhead housing has a conical load shoulder machined within its bore. In this type, the diameter of the housing below the bore is less than the diameter of the housing above the bore by a dimension equal to a radial width of the load shoulder. In another type, the wellhead housing has a groove with substantially the same diameter above and below the groove, and the load shoulder is a split ring that is installed subsequently in the groove, which allows a larger diameter bore to be employed during drilling operations. In another type, as described in U.S. Pat. No. 7,380,607, the wellhead housing has a bore containing a conical upward facing load shoulder that inclines relative to an axis of the bore; a casing hanger landed in the housing has a conical downward facing load shoulder that inclines at a lesser angle relative to an axis of the bore; and the casing hanger carries a split lock ring that is capable of supporting the hanger on the upward facing load shoulder, has an inner profile that slidingly engages the hanger's downward facing load shoulder and an outer profile that slidingly engages the housing's upward facing load shoulder, and moves between a retracted position (outer profile spaced radially inward from the upward facing load shoulder) and an expanded position (outer profile in engagement with the upward facing load shoulder).

However, in all of the above examples, the extent of split lock ring expansion, and thus the contact area and load capacity, typically is limited by the inner and outer diameters of the mating cylinders, such that one must be able to pass through the other.

BRIEF DESCRIPTION

In certain embodiments, a stackable support system for the installation of a body in a receptacle may include a load shoulder that is supported by and in a fixed position with respect to the receptacle. The system may also include an actuator that is supported by and in a fixed position with respect to the receptacle. Additionally, the system may include a top lock component adjacent to a shoulder of the body in an initial position. Further, the system may include a bottom lock component adjacent to the actuator in an initial position. Additionally, the body is configured to move with respect to the receptacle, and wherein upon movement of the body with respect to the receptacle, the top lock component is configured to move along the bottom lock component and the bottom lock component is configured to move along the actuator and the load shoulder, thereby locking the body in close alignment with the receptacle when the top lock component and the bottom lock component are in a set position.

In certain embodiments, a stackable support system for installing a body in a receptacle may include an actuator that is supported by and in a fixed position with respect to the receptacle. Additionally, the system may include a first lock ring and a second lock ring. The first and second lock rings are in a first stacked arrangement when the body is in an initial position with respect to the receptacle. Additionally, the first lock ring is disposed adjacent to the actuator and the second lock ring is disposed adjacent to a first shoulder of the body when the body is in the initial position. Further, the body is configured to move with respect to the receptacle into a second position, and the second lock ring is configured to move along the first lock ring to create a second stacked arrangement of the first and second rings upon movement of the body from the initial position to the second position. Additionally, the first lock ring is configured to move along the actuator toward the receptacle upon movement of the body from the initial position to the second position.

In certain embodiments, a method for installing a body in a receptacle may include installing a first lock component and a second lock component on the body. The first and second lock components are in a first stacked arrangement when the first and second lock components are installed on the body. Additionally, the method may include moving the body having the first and second lock components in the first stacked arrangement into an initial position relative to the receptacle. When the body is in the initial position, the first lock component is adjacent to an actuator that is supported by and in a fixed position with respect to the receptacle. Additionally, when the body is in the initial position, the second lock component is adjacent to a shoulder of the body. Further, the method may include moving the body into a second position relative to the receptacle. The second lock component is configured to move with respect to the first lock component such that the first and second lock components are moved into a second stacked arrangement different from the first stacked arrangement when the body moves into the second position.

BRIEF DESCRIPTION OF THE DRAWINGS

For a detailed description of embodiments of the present disclosure, reference will now be made to the accompanying drawings in which.

DETAILED DESCRIPTION

Figure 1:
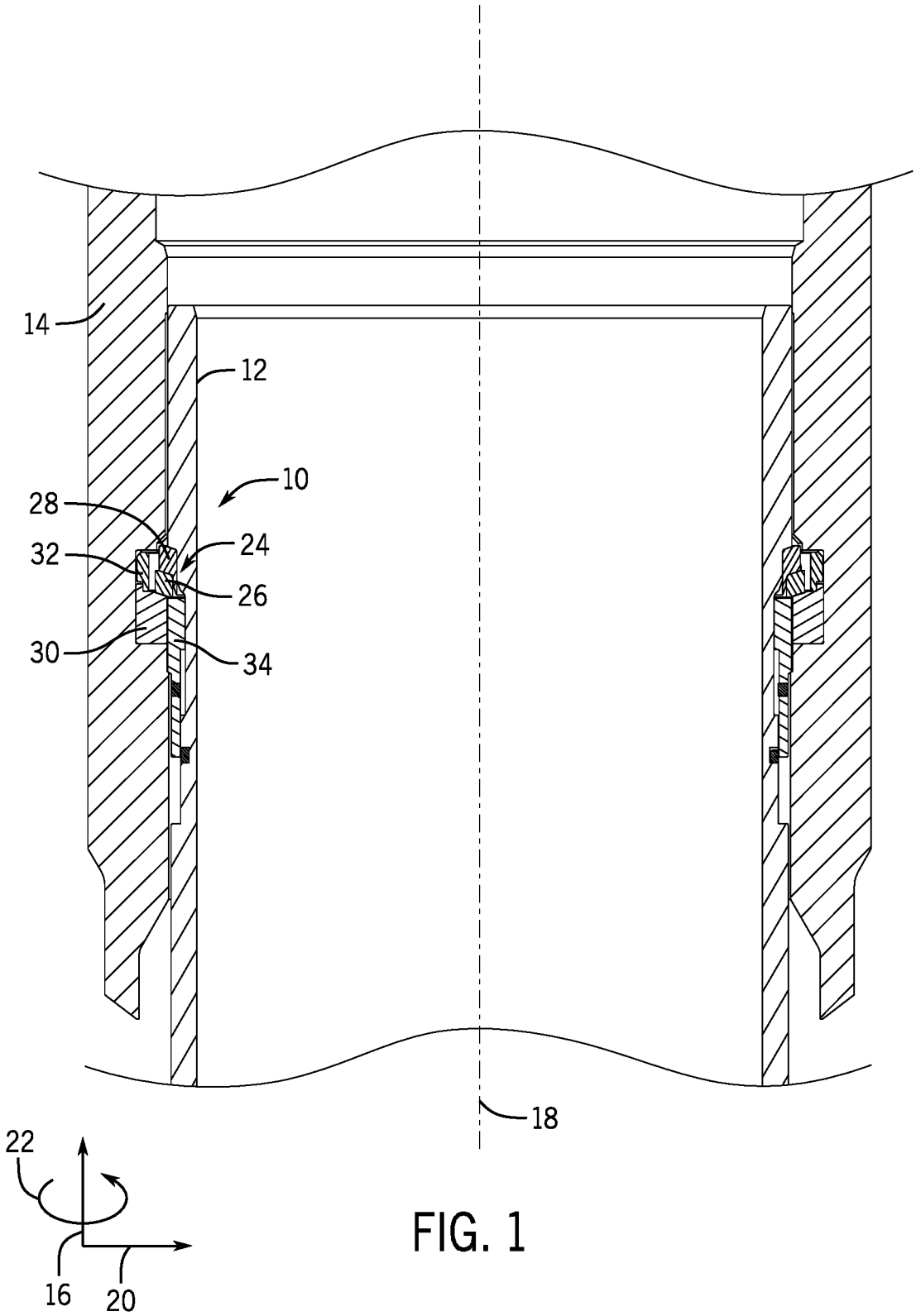
FIG. 1 depicts a cross-sectional view of a stackable support system in accordance with one or more embodiments of the present disclosure.

One or more specific embodiments of the present disclosure will be described below. These described embodiments are only exemplary of the present invention. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

This discussion is directed to various embodiments of the disclosure. The drawing figures are not necessarily to scale. Certain features of the embodiments may be shown exaggerated in scale or in somewhat schematic form, and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure and claims, the articles "a," "an," "the," and "said" are intended to mean that there are one or more of the elements. The terms "comprising," "including," and "having" are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean crosswise or perpendicular to the central axis. For instance, an axial distance refers to a distance measured along or parallel to the central axis, and a radial distance means a distance measured crosswise or perpendicular to the central axis. The use of "top," "bottom," "above," "below," "upper," "lower," "up," "down," "vertical," "horizontal," and variations of these terms is made for convenience, but does not require any particular orientation of the components. Further, as used herein, an angle of a surface relative to an axis (e.g., a vertical axis, a central axis, or a longitudinal axis) refers to an angle measured from the axis to the surface.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

In a variety of applications and industries, it may be desirable to position an intervening expanding component to lock two bodies into a fixed relationship relative to each other. For example, it may be desirable to run one ring inside of another ring to provide structural support to a cylindrical body located inside a larger cylindrical body. In particular, in order to increase the final contact area of an expanding ring, one ring can be stacked on top of another such that the top ring acts as an actuator for the one beneath it. As the narrower cylinder lands inside the larger cylinder, the rings expand in a domino effect, resulting in a greater contact between the narrow and larger cylinders than would occur if there was only one ring.

The stackable support system and method of the present disclosure may include any number of expandable rings (e.g., split rings, C-rings, etc.) which stack up on top of each other. These rings, when expanded, steadily increase in diameter, resulting in an overall larger bearing surface at the base of the rings than could have been achieved with one ring. As the contact angles of the rings dictate the relative magnitude of the radial and axial forces, the stackable support system of the present disclosure can function in any combination of angles on all surfaces, as described in detail below.

Referring to FIG. 1, a stackable support system 10 for supporting the load of a body 12 on a receptacle 14 is shown. In particular, the stackable support system 10, the body 12, and the receptacle 14 are shown in an installed (e.g., set) position in FIG. 1. The stackable support system 10 of the present disclosure can be used to mate bodies of various shapes and dimensions. Throughout the following discussion, reference may be made to various axes or directions, such as a vertical or axial direction 16 along a longitudinal axis 18 (e.g., central axis) of the body 12 and/or the receptacle 14, a horizontal or radial direction 20 away from the longitudinal axis 18, and a circumferential direction 22 around the longitudinal axis 18.

In certain embodiments, the body 12 and the receptacle 14 may be annular bodies. For example, the body 12 and the receptacle 14 may have profiles (e.g., cross-sections) that are generally cylindrical or tubular in shape, and the body 12 may be nested concentrically within the receptacle 14, as represented schematically in FIGS. 1-3 and FIGS. 6-9. For example, the receptacle 14 may be an outer cylindrical wellhead housing, and the body 12 may be an inner cylindrical casing hanger. In certain embodiments, the body 12 and/or the receptacle 14 may include a mandrel, a tool stem, a tool body, a wear bushing, an actuator ring, a wellhead housing (e.g., an inner wellhead housing, a low pressure wellhead housing, an outer wellhead housing, a high pressure wellhead housing, a conductor housing, etc.), a hanger (e.g., a tubing hanger or a casing hanger), or a string (e.g., a casing string or a tubing string). In some embodiments, and as also represented schematically in FIGS. 2-3 and FIGS. 6-9, the body 12 and the receptacle 14 may have profiles that are generally planar (e.g., rectangular) in shape. Further, it should be appreciated that the body 12 and the receptacle 14 may be bodies of other shapes, regular and irregular, and the body 12 and the receptacle 14 may be concentric bodies or nonconcentric, side-by-side bodies, for example.

As discussed in more detail below, the stackable support system 10 may include two or more lock components 24 (e.g., expanding rings, split rings, C-rings, or circumferentially spaced lock segments or locking dogs), which may stack on top of each other and may be configured to lock, secure, or fix the body 12 in alignment with the receptacle 14 when the two or more lock components 24 are in the set or installed position as shown in FIG. 1, for example. As illustrated in FIG. 1, the two or more lock components 24 may include a first lock component 26 (e.g., a bottom lock component) and a second lock component 28 (e.g., a top lock component), which is stacked on top of (e.g., disposed directly adjacent to and vertically or axially 16 above) the first lock component 26. Additionally, as discussed below, the stackable support system 10 may include a load shoulder 30 (e.g., an annular load shoulder), a retainer 32 (e.g., an annular retainer), and an actuator 34 (e.g., a driver, an annular actuator, an annular driver), which may each be supported by and in a fixed position with respect to the receptacle 14. As illustrated in FIG. 1, the first lock component 26 may be in abutment with and disposed vertically or axially 16 above the load shoulder 30 and the actuator 34 when the first and second lock components 26 and 28 are in the set position. As discussed below, by providing the two or more lock components 24, the stackable support system 10 enables a larger contact area between the first lock component 26 and the load shoulder 30 as compared to systems including only one lock component. As such, the stackable support system 10 may reduce the stresses on the first lock component 26 and the load shoulder 30 as compared to systems including only one lock component.

Figure 2:
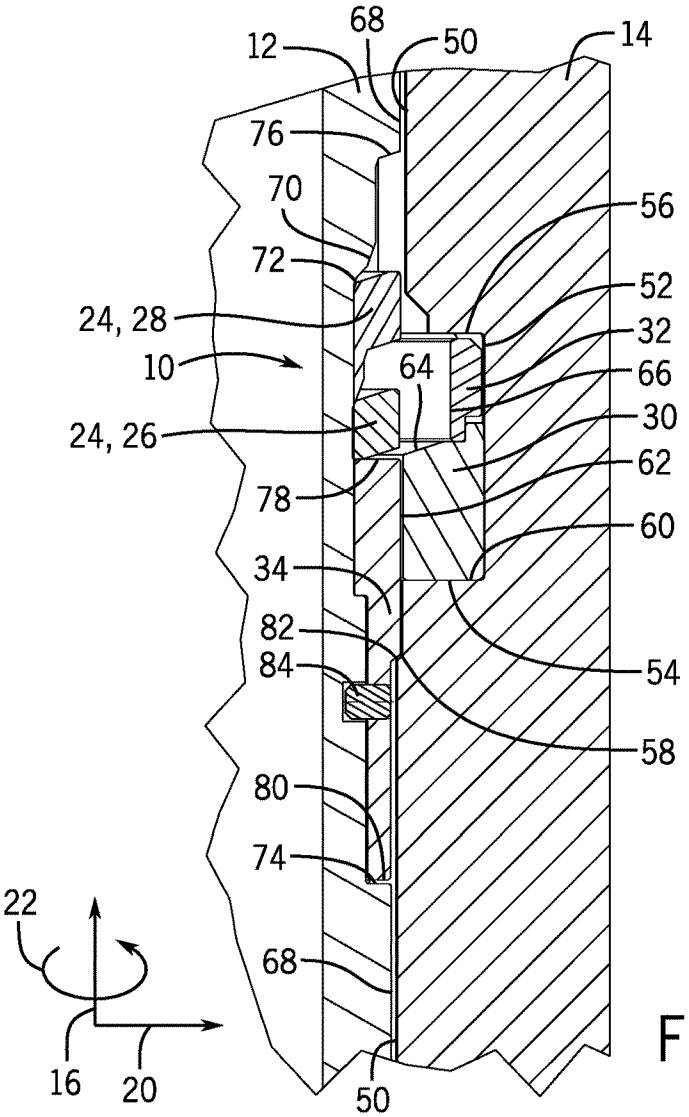
FIG. 2 depicts a cross-sectional detailed view of a stackable support system in accordance with one or more embodiments of the present disclosure when in a retracted position.

Referring now to FIG. 2, the receptacle 14 has a longitudinal face 50 (e.g., an inner longitudinal face). The longitudinal face 50 may be annular (e.g., cylindrical) or planar in certain embodiments. The receptacle 14 also may have one or more support shoulders. For example, in certain embodiments, receptacle 14 may have a cutout portion 52 (e.g., an annular cutout portion) in the longitudinal face 50 defined by a lower support shoulder 54 and an upper boundary 56 and creating a portion of smaller thickness or diameter than the profile of the longitudinal face 50 above or below the cutout portion 52. In some embodiments, the receptacle 14 may also have a support shoulder 58 below the cutout portion 52.

As noted above, the load shoulder 30 may be supported by and in a fixed position with respect to the receptacle 14. For example, as shown, the load shoulder 30 may be located within the cutout portion 52 on the lower support shoulder 54. The load shoulder 30 may include a bottom face 60 (e.g., annular or planar) for contact with the lower support shoulder 54 of the receptacle 14. Additionally, the load shoulder 30 includes a longitudinal face 62 (e.g., annular or planar) and a ramp 64 (e.g., an upwardly sloping ramp, an annular ramp, a planar ramp) that is angled inwardly from the longitudinal face 62. In embodiments in which the receptacle 14 is annular, the ramp 64 may be a curved annular surface or an angled annular surface (e.g., a conical surface). The load shoulder 30 may be one piece or component, as shown, or may be made up of two or more pieces or components. In certain embodiments, the load shoulder 30 may be a ring, a split ring, a C-ring, a segmented ring, or circumferentially spaced load members. In some embodiments, the load shoulder 30 may be a ring (e.g., a full or complete ring) that is cut or segmented into two or more pieces, and each segmented piece may be installed on the receptacle 14. In certain embodiments, the load shoulder 30 may be made from one or more metals, such as steel (e.g., a low alloy steel).

As noted above, the retainer 32 may also be supported by and in a fixed position with respect to the receptacle 14. For example, the retainer 32, which may be a ring, may be located within the cutout portion 52 on the load shoulder 30. That is, the retainer 32 may be in abutment with and disposed axially or vertically 16 above the load shoulder 30. The retainer 32 includes a longitudinal face 66. In certain embodiments, the retainer 32 may be a split ring that is subsequently fixed together (e.g., welded shut). For example, the retainer 32 may be a ring (e.g., a full or complete ring), and a portion of the retainer 32 may be cut out from the remainder of the ring and may be fixed together (e.g., welded together) with the remainder of the ring when the retainer 32 is installed on the receptacle 14. In certain embodiments, the load shoulder 30 may be made from one or more metals, such as steel (e.g., a low alloy steel).

In an embodiment, the load shoulder 30 and the retainer 32 are be formed separately from each other. In such embodiments, the load shoulder 30 and the retainer 32 may be coupled to one another (e.g., in a fixed relationship) when the load shoulder 30 and the retainer 32 are installed on the receptacle 14. For example, the load shoulder 30 may include an upwardly facing profile and the retainer 32 may include a downwardly facing profile for interlocking connection with each other.

In certain embodiments, the load shoulder 30, the retainer 32, or both may be formed integrally with the receptacle 14. In embodiments in which the load shoulder 30 is formed integrally with the receptacle 14, the longitudinal face 50 of the receptacle 14 is the longitudinal face 62 of the load shoulder 30 for the portion of the receptacle 14 in which the load shoulder 30 is integral. In embodiments in which the retainer 32 is formed integrally with the receptacle 14, the longitudinal face 50 of the receptacle 14 is the longitudinal face 66 of the retainer 32 for the portion of the receptacle 14 in which the retainer 32 is integral.

The body 12 may land within or be installed adjacent to the receptacle 14. The body 12 has a longitudinal face 68 (e.g., an outer facing longitudinal face). Accordingly, the body 12 and the receptacle 14 may be annular (e.g., cylindrical) or non-cylindrical (e.g., planar, rectangular, etc.) in shape with general (non-cutout) longitudinal surfaces 68 and 50, respectively, facing each other. In certain embodiments, if the receptacle 14 is a wellhead housing, for example, the body 12 may be a casing hanger with a lower threaded end for securing to a string of casing (not shown) that extends into a well (not shown).

The longitudinal face 68 (e.g., profile) of the body 12 may have a variable thickness or diameter. For example, the longitudinal face 68 may include in an upper portion, a downwardly sloping ramp 70 (e.g., annular or planar) that is angled down to an inwardly directed ledge or shoulder 72. Additionally, the longitudinal face 68 may include in a lower portion, an outwardly directed ledge or shoulder 74 (e.g., annular or planar). The longitudinal face 68 of the body 12 may also have a support shoulder 76 (e.g., annular or planar) located above the ramp 70.

Further, the actuator 34, which may be a ring, may be located adjacent to the longitudinal face 68 of body 12 above the shoulder 74. The actuator 34 has a top surface 78 (e.g., annular or planar), which may be flat or sloped, for example, and a bottom surface 80 (e.g., an annular or planar surface, a shoulder), which may have a shape corresponding to the shoulder 74 of the body 12. Additionally, the actuator 34 may have a shoulder 82 (e.g., annular or planar) having a shape corresponding to the support shoulder 58 of the receptacle 14. The actuator 34 may be supported by the support shoulder 58 of the receptacle 14. It should be appreciated that the actuator 34 (e.g., a driver, a ring, a split ring, a segmented ring, a C-ring, etc.) may be any suitable component or structure configured to facilitate movement of one or more of the lock components 24 (e.g., the first lock component 26 and the second lock component 28) toward the receptacle 14. For example, as discussed below, the actuator 34 may be configured to block or prevent downward movement of the first lock component 26 in the axial or vertical direction 16 with respect to the receptacle 14 and/or configured to enable movement of the first lock component 26 and the second lock component 28 in the radial or horizontal direction 20 toward the receptacle 14. In this manner, the actuator 34 may be referred to as a component that actuates (e.g., drives, moves, translates, etc.) one or more of the lock components 24 (e.g., the first lock component 26 and the second lock component 28).

Figure 3:
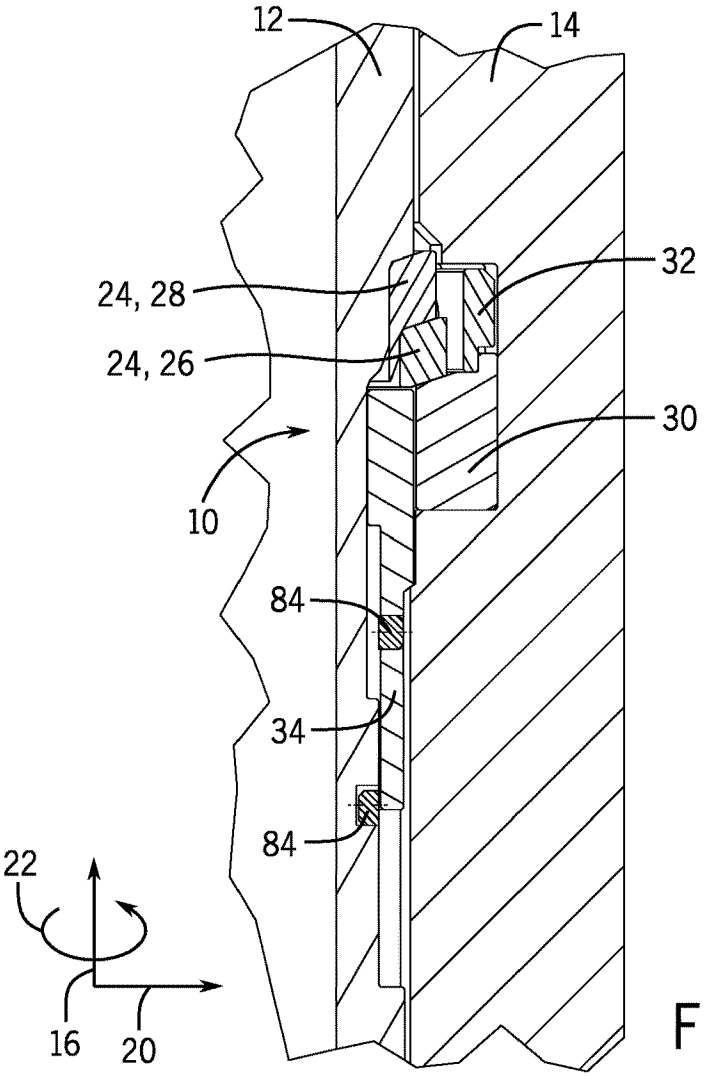
FIG. 3 depicts a cross-sectional detailed view of a stackable support system in accordance with one or more embodiments of the present disclosure when in a set position.

As noted above, the stackable support system 10 of the present disclosure has two or more stackable lock components 24 including the first lock component 26 and the second lock component 28. As shown in FIG. 2, the first lock component 26 and the second lock component 28, which are described in more detail below, are coupled to (e.g., installed on) the body 12 in an initial or retracted position. Further, as shown in FIG. 2, the second lock component 28 is disposed on the first lock component 26, which is disposed adjacent to the top surface 78 of the actuator 34. At least one shear pin 84 may be used to hold the actuator 34, and therefore the first and second lock components 26 and 28 located above the actuator 34, in place relative to body 12 in the initial position upon run-in or other installation. As shown in FIG. 3, the at least one shear pin 84 is sheared, and the first lock component 26 and the second lock component 28 are in the set position after operation and movement of first and second lock components 26 and 28 as described below. It should be appreciated that the shear pin 84 may be sheared in response to movement between the body 12 and the receptacle 14 in the axial or vertical direction 16 (e.g., due to weight applied to the body 12) and/or in the circumferential direction 22 (e.g., rotation of the body 12).

Figure 4:
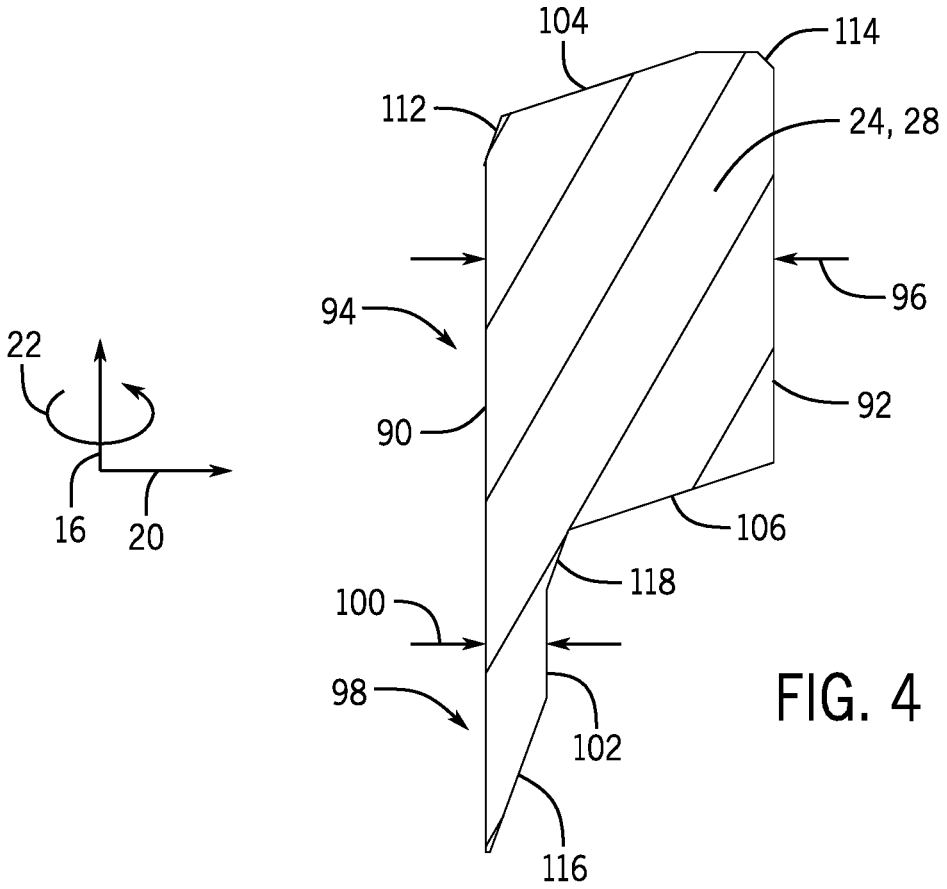
FIG. 4 depicts a top lock component in accordance with one or more embodiments of the present disclosure.

In certain embodiments, and as shown in FIG. 4, the second lock component 28 may have a first longitudinal surface 90 (e.g., an inner longitudinal surface) and a second longitudinal surface 92 (e.g., an outer longitudinal surface) opposite from the first longitudinal surface 90. The first longitudinal surface 90 may face and abut the longitudinal surface 68 of the body 12, and the second longitudinal surface 90 may face the longitudinal surface 50 of the receptacle 14 when the second lock component 28 is in the retracted position (see FIGS. 2 and 6) and in the installed position (see FIGS. 3 and 9). Accordingly, the first and second longitudinal surfaces 90 and 92 may be shaped to correspond with the longitudinal surfaces 50 and 68 (e.g., annular or cylindrical, non-cylindrical or non-annular, planar, etc.).

The second lock component 28 has a variable thickness. In particular, the second lock component 28 may include an upper portion 94 (e.g., annular portion) having a first thickness 96 and a lower portion 98 (e.g., annular portion) having a second thickness 100 that is smaller than the first thickness 96. As illustrated, the first thickness 96 may extend between the first longitudinal surface 90 and the second longitudinal surface 92, and the second thickness 100 may extend between the first longitudinal surface 90 and a third longitudinal surface 102 opposite from the first longitudinal surface 90. In some embodiments, the second thickness 100 may be between approximately 5 percent and 50 percent, 5 percent and 45 percent, 5 percent and 40 percent, 5 percent and 35 percent, 5 percent and 30 percent, or 5 percent and 25 percent of the first thickness 96. In certain embodiments, the second thickness 100 may be between approximately 15 percent and 30 percent or between approximately 20 percent and 25 percent of the first thickness 96. The second thickness 100 of the second lock component 28 informs or affects the lateral distance for movement of the first lock component 26. In particular, a larger second thickness 100 may enable a greater lateral distance for movement of the first lock component 26, thereby enabling a greater contact area between the first lock component 26 and the load shoulder 30.

In some embodiments and as shown in FIG. 4, the upper portion 94 is defined by a top surface 104 (e.g., annular surface) and a bottom surface 106 (e.g., annular surface). For example, the top and bottom surfaces 104 and 106 may extend between the first longitudinal surface 90 and the second longitudinal surface 92. In certain embodiments, the top surface 104 and the bottom surface 106 may be substantially parallel to each other (e.g., within manufacturing tolerances). In certain embodiments, the top and bottom surfaces 104 and 106 (e.g., angled annular surfaces or conical surfaces) may be angled relative to the longitudinal axis 18 (see FIG. 1) and/or the axial or vertical direction (e.g., axis) 16 in a range of 0 to 90 degrees, for example 60 to 80 degrees, where the angle may be used to change the magnitude of the axial 16, circumferential 22, and/or radial 20 forces. In some embodiments, the top and bottom surfaces 104 and 106 may be angled between approximately 40 degrees and 80 degrees, 50 degrees and 70 degrees, or 55 degrees and 65 degrees from the longitudinal axis 18.

In certain embodiments, the upper portion 94 of the second lock component 28 may have an angled, tapered, or chamfered edge (hereinafter "chamfer") 112 (e.g., annular chamfer) and may have a chamfer 114 (e.g., annular chamfer) or other means to facilitate movement of the second lock component 28 along the body 14. In particular, the chamfer 112 may extend between the first longitudinal surface 90 and the top surface 104, and the chamfer 114 may extend between the top surface 104 and the second longitudinal surface 92. The lower portion 98 of the second lock component 28 may have a chamfer 116 (e.g., annular chamfer) and/or a chamfer 118 (e.g., annular chamfer) to assist with pushing out (e.g., laterally moving) and/or expanding the first lock component 26. In particular, the chamfer 116 may extend between the first longitudinal surface 90 and the third longitudinal surface 102, and the chamfer 118 may extend between the third longitudinal surface 102 and the bottom surface 106. In some embodiments, the chamfers 112, 116, and/or 118 may be angled in a range between approximately 0 degrees to 90 degrees, 1 degree to 80 degrees, 2 degrees to 70 degrees, 3 degrees to 60 degrees, 4 degrees to 50 degrees, or 5 degrees to 40 degrees from the longitudinal axis 18 and/or the vertical direction 16. In certain embodiments, the chamfers 112, 116, and/or 118 may be angled between approximately 10 degrees and 30 degrees, between approximately 15 degrees and 25 degrees, or approximately 20 degrees from the longitudinal axis 18. It should be appreciated that in embodiments in which the second lock component 28 is annular (e.g., a ring), the chamfers 112, 114, 116, and 118 may be annular tapered surfaces or conical surfaces.

Figure 5:
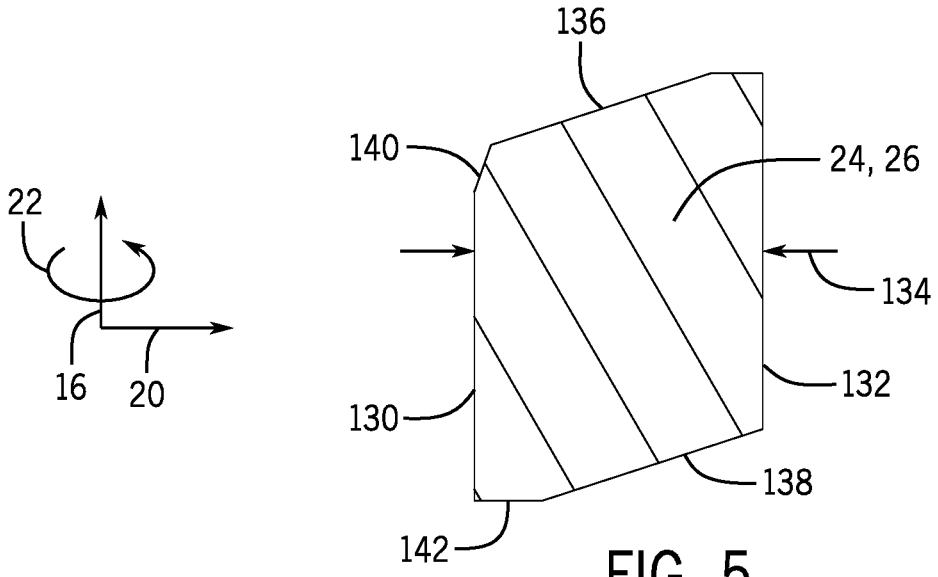
FIG. 5 depicts a bottom lock component in accordance with one or more embodiments of the present disclosure.

In certain embodiments, and as shown in FIG. 5, the first lock component 26 may have a first longitudinal surface 130 (e.g., an inner longitudinal surface) and a second longitudinal surface 132 (e.g., an outer longitudinal surface) opposite from the first longitudinal surface 130. The first longitudinal surface 130 may face and abut the longitudinal surface 68 of the body 12, and the second longitudinal surface 90 may face the longitudinal surface 50 of the receptacle 14 (e.g., the longitudinal face 66 of the retainer 32) when the first lock component 26 is in the retracted position (see FIGS. 2 and 6). Accordingly, the first and second longitudinal surfaces 130 and 132 may be shaped to correspond with the longitudinal surfaces 50 and 68 (e.g., annular or cylindrical, non-cylindrical or non-annular, planar, etc.). Additionally, as discussed below, the first longitudinal surface 130 may face and abut the third longitudinal surface 102 of the second lock component 28, and the second longitudinal surface 132 may face the longitudinal surface 50 of the receptacle 14 (e.g., the longitudinal face 66 of the retainer 32) when the first lock component 26 is in the installed position (see FIGS. 3 and 9). Additionally, the first lock component 26 may have a thickness 134 extending (e.g., an approximately constant thickness over the distance) between the first and second longitudinal surfaces 130 and 132. In certain embodiments, the thickness 134 may be approximately equal to (e.g. within manufacturing tolerances) the first thickness 96 of the second lock component 28.

Further, the bottom lock component 26 may include a top surface 136 (e.g., annular surface) and a bottom surface 138 (e.g., annular surface) that extend between the first and second longitudinal surfaces 130 and 132. In certain embodiments, the top and bottom surfaces 136 and 138 may be substantially parallel to each other and may align with or correspond to (e.g., be substantially parallel to) the bottom surface 106 of the second lock component 28 and the ramp 64 of the load shoulder 30, respectively. Additionally, the top and bottom surfaces 136 and 138 (e.g., angled annular surfaces) may be angled relative to the longitudinal axis 18 (see FIG. 1) and/or the axial or vertical direction (e.g., axis) 16 in a range of 0 to 90 degrees, for example 60 to 80 degrees, where the angle may be used to change the magnitude of the axial 16, circumferential 22, and/or radial 20 forces. In some embodiments, the top and bottom surfaces 136 and 138 may be angled between approximately 40 degrees and 80 degrees, 50 degrees and 70 degrees, or 55 degrees and 65 degrees from the longitudinal axis 18.

Additionally, the first lock component 26 may have an angled, tapered, or chamfered edge (hereinafter "chamfer") 140 and may have a chamfer 142 or other guide to facilitate movement or expansion of first lock component 70 along the second lock component 28, the actuator 34, and/or the load shoulder 30. In certain embodiments, the chamfers 140 and 142 (e.g., angled annular surfaces) may be angled in a range of 0 to 90 degrees from the longitudinal axis 18, where the angle may be used to change the magnitude of axial 16, circumferential 22, and/or radial 20 forces. In some embodiments, the chamfer 140 may be substantially parallel to the chamfer 116 of the second lock component 28 to facilitate movement of the first lock component 26 along the second lock component 28. For example, the chamfers 140 and 116 may each be angled between approximately 10 degrees and 30 degrees, between approximately 15 degrees and 25 degrees, or approximately 20 degrees from the longitudinal axis 18. Further, in certain embodiments, the chamfer 142 may be substantially parallel to the top surface 78 of the actuator 34. For example, the chamfer 142 and the top surface 78 may each be angled approximately 90 degrees from the longitudinal axis 18.

While the embodiments shown in FIGS. 4 and 5 show the top and bottom surfaces 104 and 106 of the second lock component 28 and the top and bottom surfaces 136 and 138 of the first lock component 26 as substantially parallel, in some embodiments the angles may differ such that the angle of a top surface is different from (e.g., greater than or less than) the angle of a bottom surface from a vertical axis (e.g., the longitudinal axis 18). In some embodiments, the top surface 136 of the first lock component 26 may be substantially parallel to the bottom surface 106 of the second lock component 26, and the bottom surface 138 of the first lock component 26 may be substantially parallel to the ramp 64 of the load shoulder 30 and may have a different angle than (e.g., not parallel to) the top surface 136 of the first lock component 26.

The first lock component 26 and the second lock component 28 may be constructed from one or more metals, such as, for example, steel (e.g., low alloy steel). Additionally, the first and second lock components 26 and 28 may be constructed with or without a coating on one or more sides to reduce the coefficient of friction, resist wear, and/or provide increased lubricity. If used, such coating may include, for example, a low friction coating, such as a fluoropolymer coating (e.g., Xylan® or similar material). A phosphate bath also may be used for improved corrosion resistance.

Figure 6:
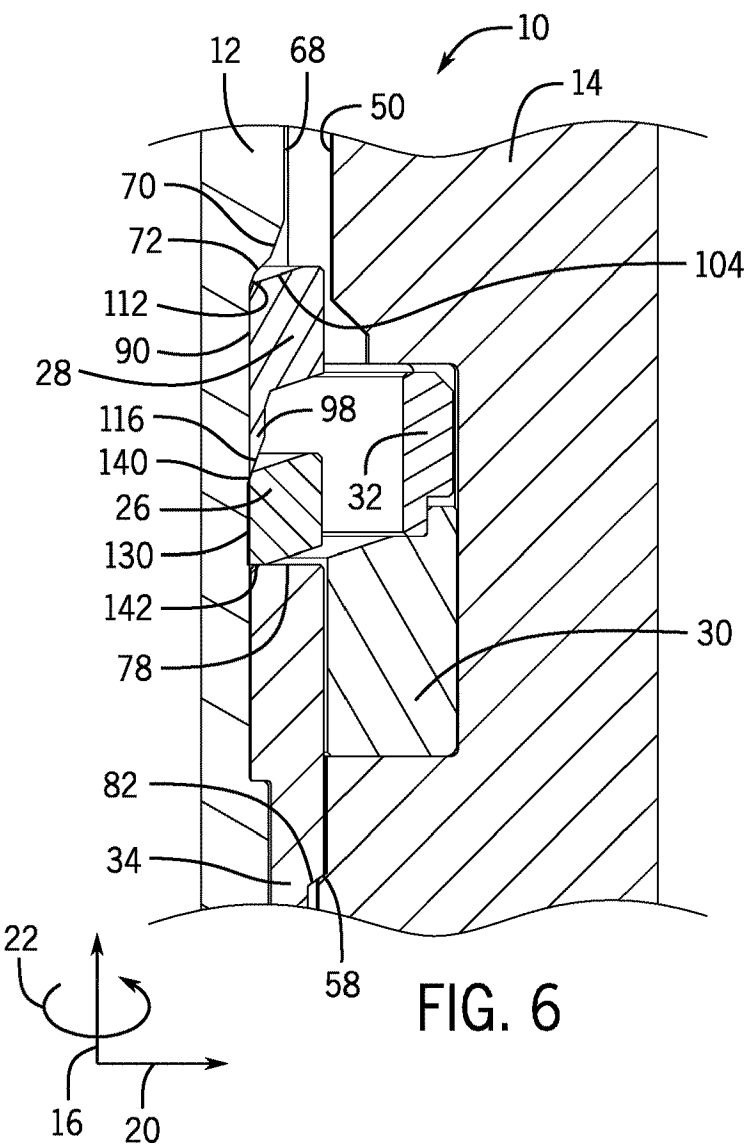

Referring now to FIGS. 6-9, an operation of an embodiment of the stackable support system 10 of the present disclosure is shown. FIG. 6 shows the system 10 in an initial or retracted position. In particular, as shown in FIG. 6, the first longitudinal surfaces 90 and 130 of the second lock component 28 and the first lock component 26, respectively, are in contact with the longitudinal surface 68 of the body 12. Additionally, the chamfer 142 of the first lock component 26 is in contact with the top surface 78 of the actuator 34. Further, the first and second lock components 26 and 28 are in an initial or a first stacked arrangement with respect to one another. In particular, the second lock component 28 is disposed above the first lock component 26 such that the chamfer 116 of the second lock component 28 is in contact with the chamfer 140 of the first lock component 26. Still further, the chamfer 112 and the top surface 104 of the second lock component 28 is in contact with the shoulder 72 of the body 12. As the body 12 and second lock component 28 move downward in the vertical or axial direction 16 with respect to receptacle 14, retainer ring 34, and the load shoulder 30, the chamfer 116 (e.g., an energizing or actuating portion) of the lower portion 98 of second lock component 28 begins to engage behind (e.g., contact) the chamfer 140 of the first lock component 26. Downward movement in the vertical or axial direction 16 of the first lock component 26 is blocked or prevented by the positioning of the actuator 34 below, which is held in place with respect to receptacle 14 by positioning of its shoulder 82 on the shoulder 58 of receptacle 14.

Figure 7:
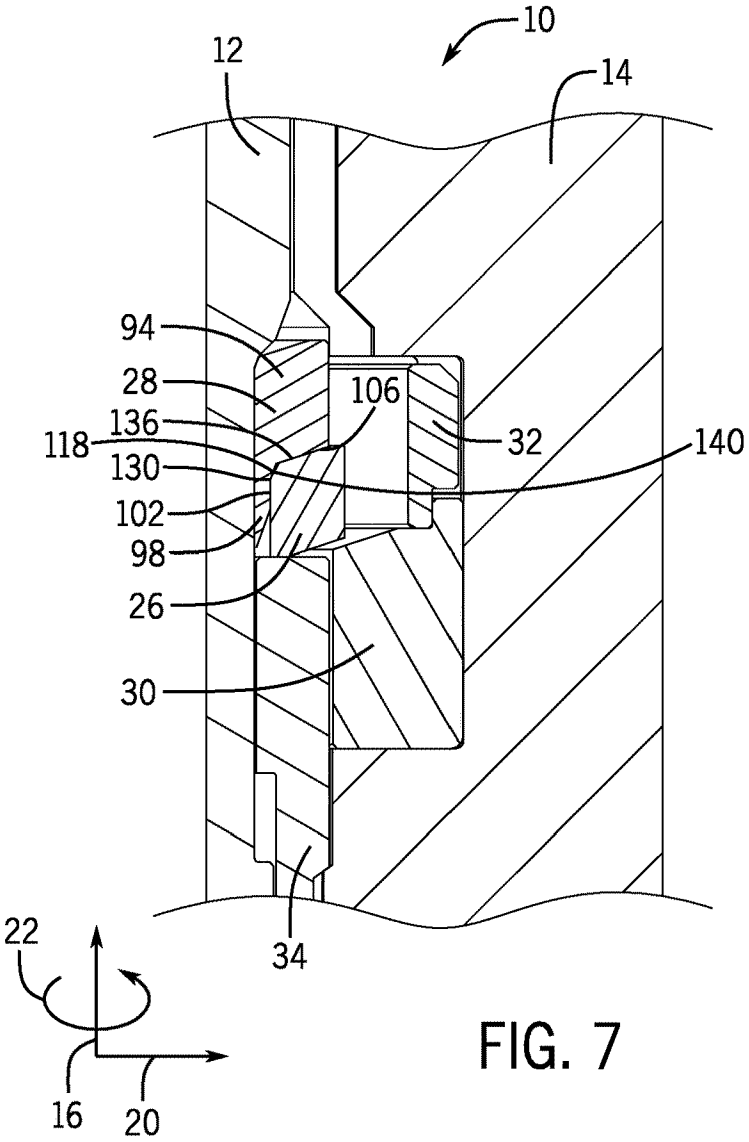
FIGS. 6 through 9 depict cross-sectional views of an operation of a stackable support system including two lock components in accordance with one or more embodiments of the present disclosure.

As shown in FIG. 7, as the body 12 continues its downward movement with respect to receptacle 14 and the actuator 34, the lower portion 98 of the second lock component 28 continues to move behind the first lock component 26, actuating or energizing the first lock component 26 as a result. Specifically, as a result of the body 12 moving relative to the receptacle 14, the lower portion 98 of the second lock component 28 is configured to move the first lock component 26 radially 20 toward the receptacle 14 such that the first lock component 26 is disposed radially 20 closer to the receptacle 14 than the lower portion 98 of the second lock component 28, and the lower portion 98 (e.g., a holding portion) of the second lock component 28 is configured to block radial 20 movement of the first lock component 26 away from the receptacle 14. In particular, as the body 12 moves into a second position with respect to the receptacle 14 as shown in FIG. 7, the body 12 moves the first and second lock components 26 and 28 into a second stacked arrangement (e.g., an axially overlapping arrangement) with respect to one another. More specifically, in the second stacked arrangement, the bottom surface 106 of the upper portion 94 of the second lock component 28 reaches (e.g., contacts) the top surface 136 of the first lock component 26, and the third longitudinal surface 102 of the second lock component 28 contacts the first longitudinal surface 130 of the first lock component 26. As a result, an axial distance between the top surface 104 of the second stacked component 28 and the bottom surface 138 of the first second stacked component 26 in the second stacked arrangement (e.g., the height of the first and second lock components 26 and 28 in the second stacked arrangement) is less than the axial distance between the top surface 104 of the second stacked component 28 and the bottom surface 138 of the first second stacked component 26 in the first stacked arrangement (e.g., the height of the first and second lock components 26 and 28 in the first stacked arrangement). The reduction in height of the first and second lock components 26 and 28 in the second stacked arrangement may enable the first and second lock components 26 and 28 to fit within the cutout portion 52. In certain embodiments, the height of the first and second lock components 26 and 28 in the second stacked arrangement may be between approximately 50 percent and 95 percent, 60 percent and 90 percent, 65 percent and 85 percent, or 70 percent and 80 percent of the height of the first and second lock components 26 and 28 in the first stacked arrangement.

Additionally, in the second stacked arrangement, the chamfer 118 (e.g., a holding portion) of the lower portion 98 of second lock component 28 contacts the chamfer 140 of the first lock component 26. Further, when the body 12 moves into the second position, the first lock component 26 is displaced along the actuator 34 in the horizontal or radial direction 20 toward the load shoulder 30. In certain embodiments, the shear pin 84 (see FIGS. 2 and 3) may be sheared (e.g., by applying weight to the body 12 and/or rotating the body 12) to enable the body 12 to move downward with respect to the receptacle 14 and the actuator 34 into the position shown in FIG. 7.

Figure 8:
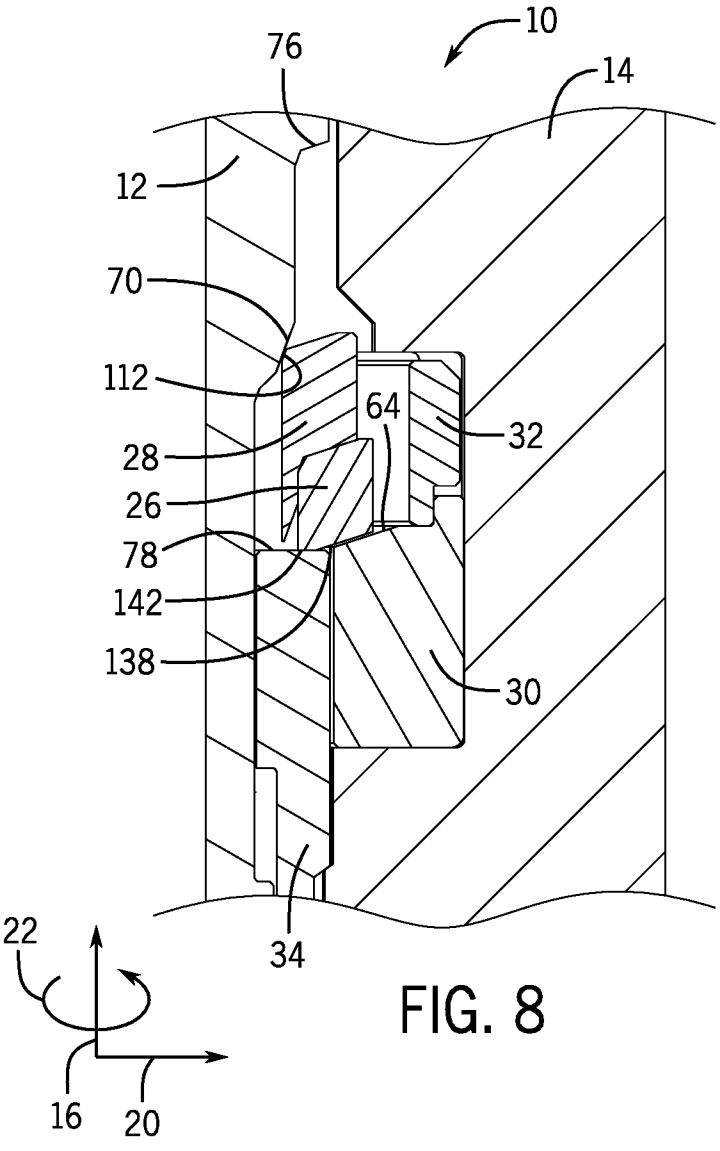

Referring now to FIG. 8, as the body 12 continues its downward movement, the ramp 70 (e.g., an energizing taper or portion) of the body 12 pushes, via the chamfer 112, the second lock component 28 and thereby the first lock component 26 outwardly in the horizontal or radial direction 20 toward receptacle 14. That is, the ramp 70 of the body 12 moves the first and second lock components 26 and 28 in the second stacked arrangement toward the receptacle 14. As the leading portion of the bottom surface 138 of the first lock component 26 reaches the ramp 64 of the load shoulder 30, the first lock component 26 moves upward in the vertical or axial direction 16 and outward in the horizontal or radial direction 20 toward the retainer ring 32 and the receptacle 14. As discussed above, to facilitate the movement of the first lock component 26 along the actuator 34 and the load shoulder 30, the chamfer 142 of the first lock component 26 may be substantially parallel to the top surface 78 of the actuator 34, and the bottom surface 138 of the first lock component 26 may be substantially parallel to the ramp 64 of the load shoulder 30. Additionally, to facilitate the movement of the second lock component 28 and thereby the first lock component 26 toward the receptacle 14, the chamfer 112 of the second lock component 28 may be substantially parallel to the ramp 70 of the body 12.

Figure 9:
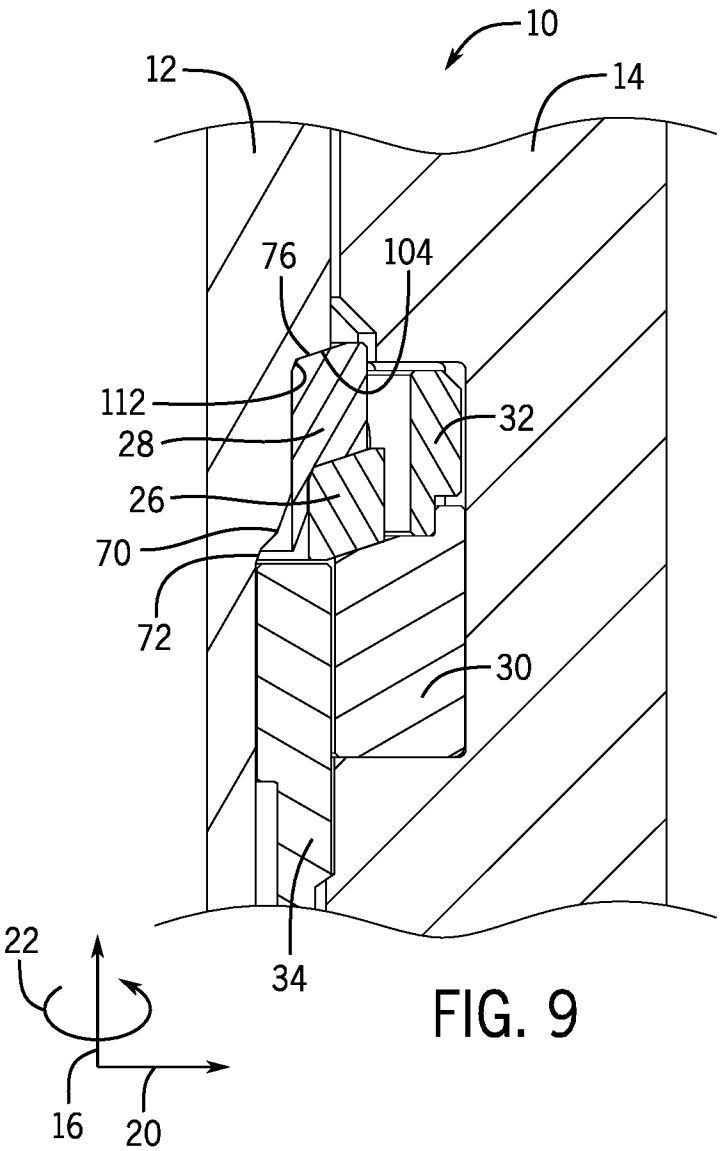

Referring now to FIG. 9, it is shown that the body 12 has completed its downward movement in the vertical or axial direction 16 relative to receptacle 14, as further movement is prevented by the first and second locking components 26 and 28, and the first and second lock components 26 and 28 of the stackable support system 10 are in the second stacked arrangement and in the set position. In particular, the body 12 has moved vertically downwardly such that the shoulder 72 and the ramp 70, initially located above the chamfer 112 of the second lock component 28 (see FIG. 6), are now located below the chamfer 112 of the second lock component 28 (see FIG. 9). As shown in FIG. 9, in the set position, the support shoulder 76 of the body 12 has moved downwardly in the vertical or axial direction 16 to a position adjacent to the top surface 104 of the second lock component 28, and the body 12 is locked in place relative to the receptacle 14. In particular, the support shoulder 76 of the body 12 and a portion of the longitudinal surface 68 of the body 12 disposed between the support shoulder 76 and the ramp 70 may be referred to as a holding portion that is configured to block radial 20 movement of the first and second lock components 26 and 28 away from the receptacle 14.

Figure 12:
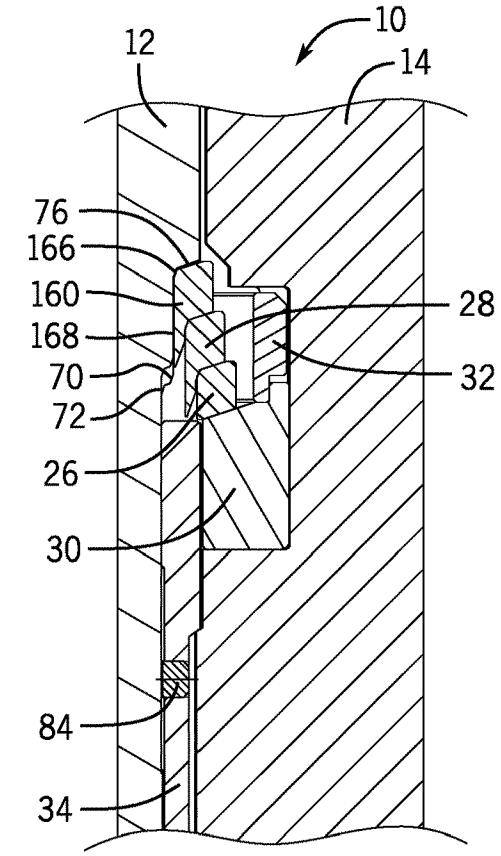
FIGS. 10 through 12 depict cross-sectional views of an operation of a stackable support system including three lock components in accordance with one or more embodiments of the present disclosure.
Figure 11:
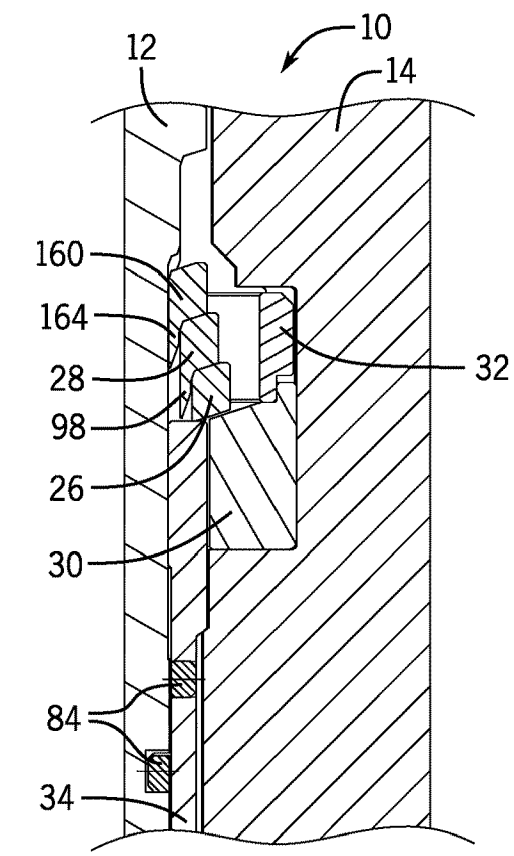
Figure 10:
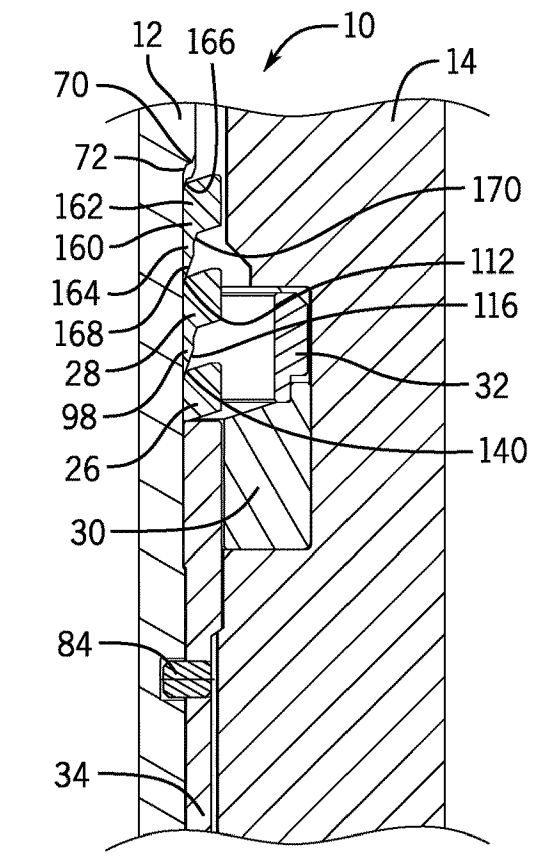

While the embodiments shown in FIGS. 1-3 and 6-9 relate to embodiments of the stackable support system 10 including two lock components 24 (i.e., the first lock component 26 and the second lock component 28), as noted above, the stackable support system 10 may include more than two lock components 24 in certain embodiments. For example, FIGS. 10-12 illustrate an operation of an embodiment of the stackable support system 10 including the first lock component 26, the second lock component 28, and a third lock component 160 (e.g., an annular lock component). In particular, FIG. 10 illustrates the stackable support system 10 in an initial or retracted position in which the first, second, and third lock components 26, 28, and 160 are installed on the body 12. In some embodiments, as shown in FIGS. 10-12, the third lock component 160 may have substantially the same shape and dimensions as the second lock component 28. For example, the third lock component 160 may include an upper portion 162 with a first thickness, a lower portion 164 with a second thickness that is smaller than the first thickness, a chamfer 166 in the upper portion 162, and chamfers 168 and 170 in the lower portion 164 such that the shape of the third lock component 160 generally corresponds to or is substantially the same as the shape of the second lock component 28. In certain embodiments, the third lock component 160 may differ from the second lock component 28 in shape and/or one or more dimensions. For example, the thickness of the lower portion 164 of the third lock component 160 may be less than or greater than the second thickness 100 (see FIG. 4) of the lower portion 98 of the second lock component 28.

As shown in FIG. 10, the third lock component 160 is disposed on the second lock component 28. In particular, the chamfer 168 of the third lock component 160 is in contact with the chamfer 112 of the second lock component 28. Additionally, the chamfer 166 of the third lock component 160 is in contact with the shoulder 72 of the body 12. As the body 12 and third lock component 150 move downward in the vertical or axial direction 16 with respect to receptacle 14, retainer ring 32, and the load shoulder 30, the chamfer 168 of the lower portion 164 of the third lock component 160 begins to engage behind the chamfer 112 of the second lock component 28. Additionally, as discussed above with respect to FIG. 6, the chamfer 116 of the second lock component 28 begins to engage behind the chamfer 140 of the first lock component 26. Downward movement in the vertical or axial direction 16 of the first lock component 26 is blocked or prevented by the positioning of the actuator 34 as discussed above with respect to FIG. 6.

As shown in FIG. 11, the shear pin 84 may be sheared to enable the body 12 to continue its downward movement with respect to receptacle 14 and the actuator 34. Further, the lower portion 164 of the third lock component 160 may actuate or displace the second lock component 28 in the horizontal or radial direction 20 toward the load shoulder 30 and the receptacle 14. Similarly, as discussed above with respect to FIG. 7, the lower portion 98 of the second lock component 28 actuates or displaces the first lock component 26 in the horizontal or radial direction 20 toward the load shoulder 30 and the receptacle 14.

Referring now to FIG. 12, it is shown that the body 12 has completed its downward movement in the vertical or axial direction 16 relative to receptacle 14, as further movement is blocked or prevented by the first, second, and third locking components 26, 28, and 160, and the first, second, and third lock components 26, 28, and 160 of the stackable support system 10 are in the set position. In particular, the body 12 has moved vertically downwardly such that the shoulder 72 and the ramp 70, initially located above the chamfer 166 of the third lock component 160 (see FIG. 10), are now located below the chamfer 168 of the third lock component 160 (see FIG. 10). Additionally, as shown in FIG. 12, in the set position, the support shoulder 76 of the body 12 has moved downwardly in the vertical or axial direction 16 to a position adjacent to a top surface 170 of the third lock component 160, and the body 12 is locked in place relative to the receptacle 14.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A stackable support system for the installation of a body in a receptacle, comprising:

a load shoulder that is supported by and in a first fixed position with respect to the receptacle;

an actuator that is supported by and in a second fixed position with respect to the receptacle;

a top lock component adjacent to a shoulder of the body in a first initial position; and a bottom lock component adjacent to the actuator in a second initial position;

wherein the body is configured to move with respect to the receptacle to cause radial movement of the top lock component and the bottom lock component into a set position, and wherein upon movement of the body with respect to the receptacle, the top lock component is configured to move along the bottom lock component and the bottom lock component is configured to move along the actuator and the load shoulder, thereby locking the body with the receptacle when the top lock component and the bottom lock component are in the set position.

2. The system of claim 1, wherein the top lock component comprises an upper portion having a first thickness and a lower portion having a second thickness that is less than the first thickness.

3. The system of claim 2, wherein the second thickness is between approximately five percent and thirty-five percent of the first thickness.

4. The system of claim 2, wherein the upper portion comprises a first chamfered edge, and wherein the lower portion comprises a second chamfered edge, and wherein the first chamfered edge is configured to abut the shoulder of the body and the second chamfered edge is configured to abut a third chamfered edge of the bottom lock component when the top lock component and the bottom lock component are in their respective first and second initial positions.

5. The system of claim 4, wherein the lower portion comprises a fourth chamfered edge that is closer to the upper portion than the second chamfered edge, and wherein the fourth chamfered edge is configured to abut the third chamfered edge of the bottom lock component when the top lock component and the bottom lock component are in the set position.

6. The system of claim 5, wherein the bottom lock component comprises:

a first longitudinal surface;

a top surface, wherein the third chamfered edge of the bottom lock component extends between the first longitudinal surface and the top surface, and wherein the third chamfered edge is substantially parallel to a top surface of the load shoulder;

a bottom surface opposite from the top surface; and a fifth chamfered edge extending between the first longitudinal surface and the bottom surface, and wherein the fifth chamfered edge is substantially parallel to a top surface of the actuator.

7. The system of claim 5, wherein the upper portion of the top lock component is defined by a first top surface and a first bottom surface, and wherein the fourth chamfered edge of the top lock component extends between the first bottom surface of the upper portion and a first longitudinal surface of the lower portion, and wherein the bottom lock component comprises:

a second longitudinal surface that faces the first longitudinal surface of the lower portion of the top lock component when the top and bottom lock components are in the set position; and a second top surface that is substantially parallel to the first bottom surface of the top lock component, wherein the third chamfered edge of the bottom lock component extends between the second longitudinal surface and the second top surface.

8. The system of claim 7, wherein the bottom lock component comprises:

a second bottom surface opposite from the second top surface, wherein the second bottom surface is substantially parallel to a third top surface of the load shoulder; and a fifth chamfered edge extending between the second longitudinal surface and the second bottom surface, and wherein the fifth chamfered edge is substantially parallel to a fourth top surface of the actuator.

9. The system of claim 1, wherein both the body and the receptacle are cylindrical, and wherein the top lock component and the bottom lock components each comprise an expandable ring.

10. A stackable support system for installing a body in a receptacle, comprising:

an actuator that is supported by and in a first fixed position with respect to the receptacle;

a first lock ring and a second lock ring, wherein the first and second lock rings are in a first stacked arrangement when the body is in an initial position with respect to the receptacle, and wherein the first lock ring is disposed adjacent to the actuator and the second lock ring is disposed adjacent to a first shoulder of the body when the body is in the initial position;

wherein the body is configured to move with respect to the receptacle from the initial position into a second position to cause radial movement of the first lock ring and the second lock ring, and wherein the second lock ring is configured to move along the first lock ring to create a second stacked arrangement of the first and second rings upon movement of the body from the initial position to the second position, and wherein the first lock ring is configured to move along the actuator toward the receptacle upon movement of the body from the initial position to the second position.

11. The system of claim 10, wherein the second lock ring comprises:

a first portion having a first thickness and defined by a first top surface and a first bottom surface, wherein the first portion comprises a first chamfered edge that is configured to abut the first shoulder of the body when the body is in the initial position; and a second portion extending from the first portion and having a second thickness less than the first thickness, wherein the second portion comprises a second chamfered edge and a third chamfered edge, and wherein the second chamfered edge is configured to abut a fourth chamfered edge of the first lock ring when the first and second lock rings are in the first stacked arrangement, and wherein the third chamfered edge is configured to abut the fourth chamfered edge when the first and second lock rings are in the second stacked arrangement.

12. The system of claim 11, wherein the first lock ring comprises a second top surface extending from the fourth chamfered edge, wherein the second top surface is substantially parallel to and configured to abut the first bottom surface of the second lock ring when the first and second lock rings are in the second stacked arrangement.

13. The system of claim 12, wherein the first lock ring comprises:

a second bottom surface opposite from the second top surface; and a fifth chamfered edge that extends from the second bottom surface and is substantially parallel to a third top surface of the actuator, wherein the fifth chamfered edge is configured to move along the third top surface of the actuator when the body moves from the initial position to the second position.

14. The system of claim 12, comprising a load shoulder disposed adjacent to the actuator and in a second fixed position with respect to the receptacle, wherein the load shoulder comprises a fourth top surface that is substantially parallel to the second bottom surface of the first lock ring, and wherein the body is configured to move with respect to the receptacle into a third position, and wherein when the body moves from the second position to the third position, the first and second lock components in the second stacked arrangement are configured to move along the actuator and the load shoulder toward the receptacle such that the second bottom surface of the first lock ring is configured to abut the fourth top surface of the load shoulder.

15. A system, comprising:

a stackable support assembly, comprising:

a first lock configured to be positioned radially between a first tubular body and a second tubular body relative to a longitudinal axis; and a second lock configured to be positioned radially between the first tubular body and the second tubular body, wherein the first lock is configured to move axially and radially relative to the longitudinal axis along a portion of the second lock, wherein the first and second locks are configured to move at least radially relative to the longitudinal axis into a locked position between the first and second tubular bodies.

16. The system of claim 15, wherein the first and second locks are configured to move at least partially into a recess in a sidewall of the second tubular body.

17. The system of claim 16, wherein the stackable support assembly comprises a load shoulder and a retainer disposed in the recess.

18. The system of claim 16, wherein the first lock comprises a first tapered surface configured to move along a second tapered surface within the recess.

19. The system of claim 15, wherein the second lock is configured to move axially and radially along a ramp on the first tubular body.

20. The system of claim 15, wherein the stackable support assembly comprises an actuator having a shear pin configured to shear to enable movement of the actuator to drive actuation of the first and second locks, wherein the actuation of the first and second locks comprises the first lock moving axially and radially along the portion of the second lock and the first and second locks moving at least radially into the locked position.

21. The system of claim 15, wherein the stackable support assembly comprises a third lock, wherein the second lock is configured to move axially and radially relative to the longitudinal axis along a portion of the third lock, wherein the first, second, and third locks are configured to move at least radially relative to the longitudinal axis into the locked position between the first and second tubular bodies.

* * * * *